United States Patent [19]

Kugler

[11] 4,243,502

[45] Jan. 6, 1981

[54] CATHODE FOR A REDUCTION POT FOR THE ELECTROLYSIS OF A MOLTEN CHARGE

[75] Inventor: Tibor Kugler, Thayngen, Switzerland

[73] Assignee: Swiss Aluminium Ltd., Chippis, Switzerland

[21] Appl. No.: 47,017

[22] Filed: Jun. 11, 1979

[30] Foreign Application Priority Data

Apr. 7, 1978 [CH] Switzerland ..... 7258/78

[51] Int. Cl.[3] ..... C25C 3/08; C25C 3/16; C25C 7/02

[52] U.S. Cl. ..... 204/243 R; 204/289; 204/290 F; 204/294; 204/286

[58] Field of Search ..... 204/243 R-247, 204/67, 288-289, 286, 290 F, 294

[56] References Cited

U.S. PATENT DOCUMENTS

| | | | |
|---|---|---|---|
| 3,321,392 | 5/1967 | McMinn et al. | 204/67 X |
| 3,475,314 | 10/1969 | Johnston | 204/243 R |
| 3,589,988 | 6/1971 | Winand | 204/64 R |
| 4,071,420 | 1/1978 | Foster et al. | 204/243 R X |
| 4,177,128 | 12/1979 | Rahn | 204/243 R |

FOREIGN PATENT DOCUMENTS

| | | | |
|---|---|---|---|
| 7806054 | 12/1978 | Netherlands | 204/243 R |

*Primary Examiner*—T. Tung
*Assistant Examiner*—D. R. Valentine
*Attorney, Agent, or Firm*—Bachman and LaPointe

[57] ABSTRACT

A wettable cathode for an electrolytic cell for the electrolysis of a molten charge, in particular for the production of aluminum, where the said cathode comprises individual, exchangeable elements each with a component part for the supply of electrical power. The elements are connected electrically, via a supporting element, by molten metal which has separated out in the process. The interpolar distance between the anodes and the vertically movable cathode elements is at most 2 cm.

26 Claims, 13 Drawing Figures

FIG. 11
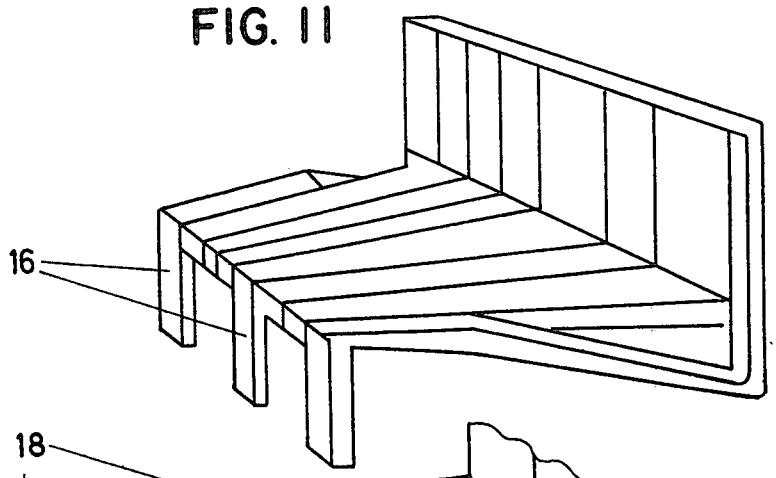
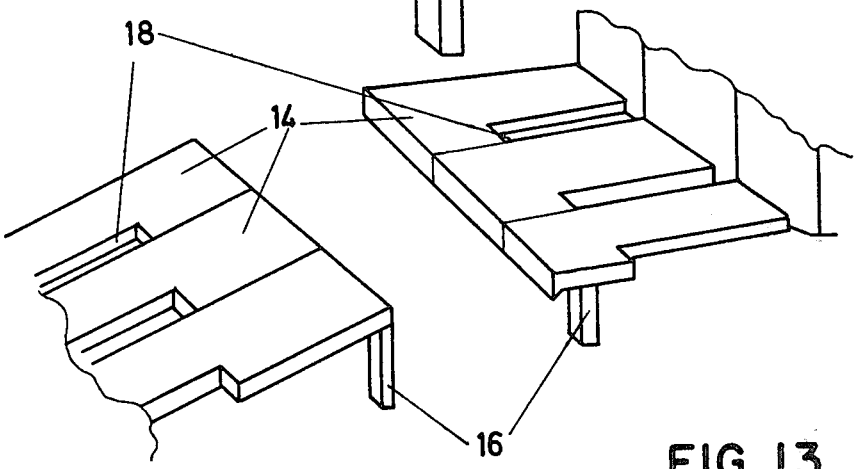
FIG. 12
FIG. 13

CATHODE FOR A REDUCTION POT FOR THE ELECTROLYSIS OF A MOLTEN CHARGE

BACKGROUND OF THE INVENTION

The invention concerns a wettable cathode for an electrolytic cell for the electrolysis of a molten charge, in particular for the production of aluminum.

The use of wettable cathodes is known in connection with the production of metals by electrolytic reduction of a molten electrolyte. In the production of aluminum with electrolytic cells representing the state of the art, it is known that cathodes made of titanium boride, titanium carbide, pyrolitic graphite, boron carbide and other substances have been proposed, including mixtures of these substances which can be sintered together.

Cathodes which can be wet with aluminum, and which are not or only slightly soluble in aluminum, offer decisive advantages over conventional electrolytic cells in which the interpolar distance is approximately 6 to 6.5 cm. The aluminum deposited at the cathode flows over the cathode surface facing the anode surface even when the layer formed there is very thin. It is therefore possible to lead the liquid aluminum out of the gap between the anode and the cathode into a sump outside this gap. Because the layer of aluminum on the surface of the cathode is thin, there are no irregularities such as those which occur in conventional electrolytic reduction due to differences in thickness of the aluminum layer produced by electromagnetic and convection forces. Consequently, the interpolar distance can be reduced without a loss in yield i.e. significantly less energy is required per unit of metal electrolyzed.

In the U.S. Pat. No. 3,400,061 an electrolytic cell is proposed with wettable cathodes attached to the carbon floor of the cell. The cathode plates are slightly inclined, with respect to the horizontal, towards the middle of the cell. The gap between the anode and cathode i.e. the interpolar distance, is much smaller than in conventional cells with a carbon floor. This makes the circulation of electrolyte between anode and cathode more difficult. As the aluminum is deposited, the alumina content of the cryolite melt drops, and the anode effect can occur. Only a small part of the floor of the cell is available for collecting the liquid metal. In order that the tapping interval is not so short as to be uneconomical, the sump must be deep which in turn calls for extra insulation of the floor of the cell.

Furthermore, it should be noted that it is difficult to achieve proper electrical contact between the carbon floor and the wettable cathode plates with the mass used for this purpose. The electrical resistance of the floor of the cell is consequently increased. As with the normal electrolytic cells, the floor is made of electrically conductive carbonaceous material which provides poor thermal insulation.

Wettable cathodes are also employed in the process according to the German Pat. No. 26 56 579. In this publication the circulation of the cryolite melt is improved by anchoring the cathode elements in the electrically conductive floor and, in the area below the anode, having these project out of the aluminum gathered on the rest of the cell floor. In the case in question the cathode elements are tubes which are closed at one end, made of material which is wet by aluminum and completely filled with liquid aluminum. Gaps between the cathode elements, above the liquid aluminum, make the circulation of the electrolyte easier. The size of this gap is chosen such that there is no significant electrical contact between the anode and the liquid aluminum. The means of supplying electrical power to the cathode elements, described in the German patent, suffer from the disadvantages associated with power supply made through the carbon floor. The electrolyte flows in a whirlpool-like manner around the cathode element i.e. no direction in particular being preferred. Consequently, the alumina concentration is not distributed in the best possible manner.

One disadvantage of arrangements with wettable cathodes which have been tested in practice is that the cathode is anchored in the floor of the cell. For economic reasons therefore one must choose for the wettable cathode plates a material with a service life which is at least equal to or better than that of the lining of the cell. The use of a cheaper material with a shorter service life or simpler manufacturing technology means that with the failure of only a small part of the cathode element, for example due to mistakes in operation or manufacture, there is the risk of having to shut down the whole cell. The carbon floor with cast-in cathode bars is in fact extremely sensitive to flaws during manufacture.

The inventor set himself the task of developing a wettable cathode for a molten salt electrolytic cell, in particular for a cell for the production of aluminum, in which a considerable reduction in the interpolar distance is permitted, without disadvantageously affecting the circulation of the electrolyte and the collection of the deposited metal, the said wettable cathode to be such that it can be manufactured by straightforward technology from favorably priced material, without reducing the lifetime of the cell.

SUMMARY OF THE INVENTION

This object is achieved by way of the invention in that the cathode comprises individual, exchangeable elements each with at least one component for power supply.

The horizontal geometric dimensions of the cathode elements preferably match the corresponding dimensions of the anodes. On inserting or changing a cathode element, the anode above it can be removed without requiring a great deal of time. For the following reasons this is of decisive advantage:

(a) The most favorably priced material for wettable cathodes can be selected. If the service life of the cathode plate is shorter than that of the cell lining, a new element can be inserted without problem. Materials which have been found to be particularly suitable for this purpose are titanium carbide, titanium diboride or pyrolitic graphite.

(b) The manufacturing technology can be simple; defective cathode elements can be replaced without interrupting production.

(c) In the case of cells which do not run well or are inefficient, differently shaped cathode elements can be employed.

The carbon anodes employed in the conventional electrolytic reduction process for the production of aluminum burn away about 1.5 to 2 cm per day. With the use of wettable cathodes from which the deposited metal continuously flows in the form of a film, the anodes have therefore to be lowered either continuously or at brief intervals.

When using cathode elements, the anodes—also when carbon anodes are used—can be left in a fixed position and the cathode elements raised, either individually or simultaneously, to regulate the interpolar distance.

Although the cathode elements are preferably made completely from material which is wettable by the metal separating out, it is also possible to have only a layer of this wettable material covering the whole of the cathode surface.

By supplying current to the cathode elements directly, the problems associated with power transfer from the carbon floor to the wettable cathode plates are overcome.

It has also been found—contrary to the view representing the state of the art—that the way power is supplied from the source to the cathode surface is of decisive importance for the running of the cell. The cathode elements and the power supply to the cathode elements are therefore in terms of the invention such that the electrolyte between anode and cathode is subjected to a magneto-hydrodynamic pumping effect under the influence of the electrolyte stream and the magnetic field. The electrolyte is thus led through the channels in the cathode elements and then in the direction of the opening where the cell is fed e.g. with alumina. At the same time the electrolyte enriched with the metal compound, for example alumina, is sucked from that opening into the interpolar gap.

BRIEF DESCRIPTION OF THE DRAWINGS

The invention will now be explained in greater detail with the help of schematic drawings viz.

FIGS. 11, 12 and 13: Perspective views of cathode elements for the electrolytic cell shown in FIGS. 9 and 10.

DETAILED DESCRIPTION

Figure 1:
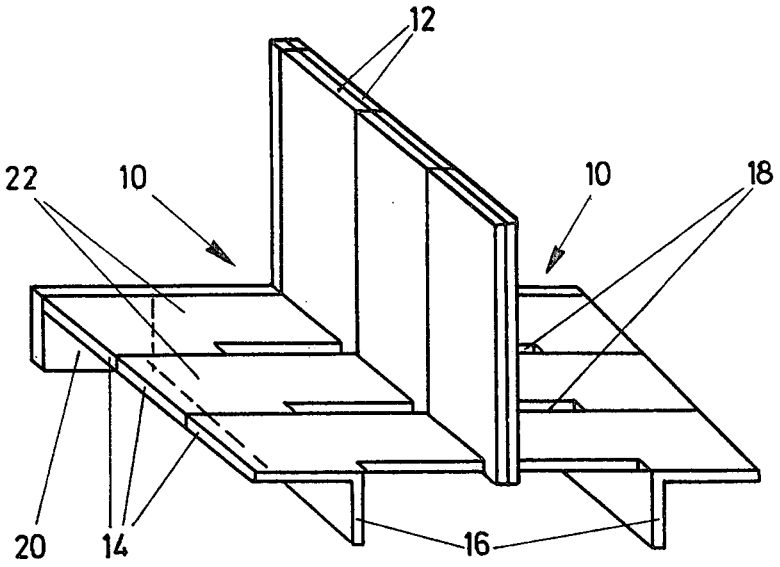
FIG. 1: A perspective view of two cathode elements made up of sub-elements, and joined by means of the component parts for supplying electrical power.

In FIG. 1 two cathode elements 10 are shown with the conductors 12 for supplying them with electrical power. These conductors can be releasably joined, for example by means of screws or a clamping rail. Each cathode element 10 is made up of a plurality of sub-elements 14 which are preferably arranged side-by-side in the direction of the longer axis of the anode. The sub-elements 14 comprise vertical power conductors 12, horizontal plates with active surfaces 22 and supporting plates 16 which are also for conducting electrical power. A recess 18 is provided on one side of the horizontal cross-piece between the conductor 12 and plate 16. Consequently, when the sub-elements are fitted together to make a cathode element, there is an opening or gap between the sub-elements, the length of which is the same as that of the recess.

The cathode element 10 made up of sub-elements 14 can be provided with an end plate 20 which runs at least a part of the length of the cathode element.

The construction of the cathode elements from sub-elements is preferred for technical reasons associated with their manufacture; they can however also be made as single pieces.

The cathode elements 10 are arranged in the cell in such a way that the plates 16 stand on the carbon floor 42, or at least touch the surface of the metal which has separated out. This ensures the deposited metal has negative polarity. If desired, the plates 16 can be inserted into appropriately shaped grooves in the carbon floor.

The cathode elements are positioned in the cell such that their working faces 22 are situated directly under the anodes which are mounted in place afterwards. The interpolar distance i.e. the distance between the working faces of the anode and the cathode is much smaller than in the classical electrolytic cell; it amounts to not more than 2 cm, preferably 1 to 2 cm. The interpolar distance chosen is determined by the composition of the molten electrolyte, the yield per unit of electricity consumed, and the heat losses of the cell, as a function of the size of the cell and the thermal insulation. The distance of the cathode plates with working surface 22 from the top surface of the molten metal 44 amounts to at least 4 cm, preferably 6 to 12 cm.

The vertical power supply component 12 of the cathode element 10 is arranged at such a distance from the adjacent side-wall of the anode that the electrical power transmitted there is much less than that between the bottom face of the anode and the working face 22 of the cathode element. The distance between a power conducting part and the adjacent side-wall of the anode is in general 3 to 10 cm.

Figure 2:
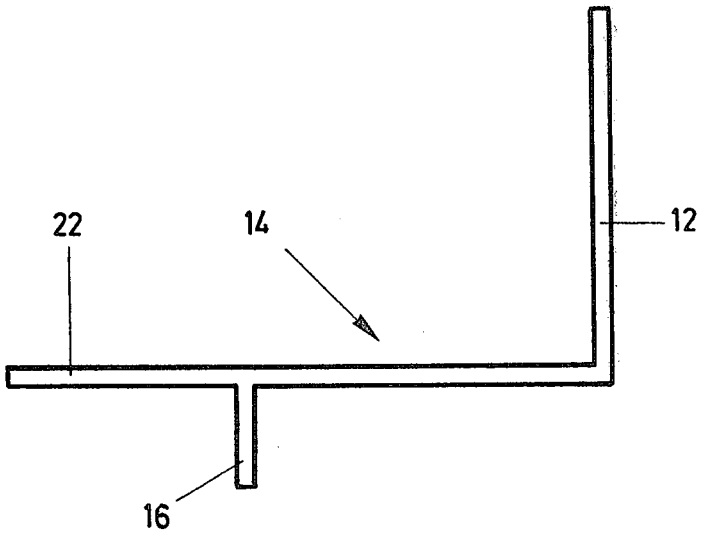
FIGS. 2 and 3: A vertical section through a sub-element.
Figure 3:
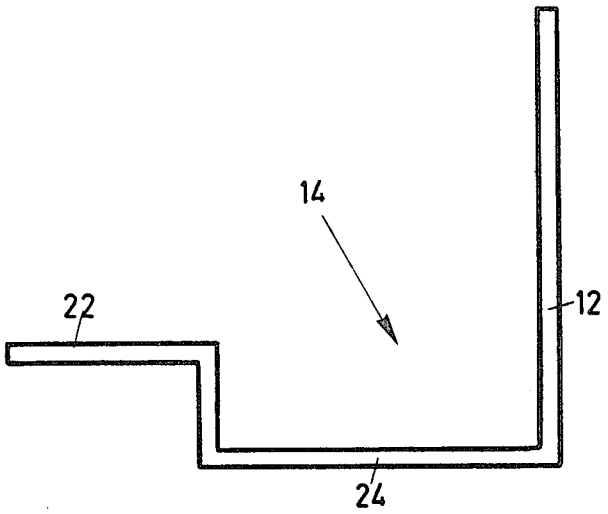

FIGS. 2 and 3 show sub-elements 14 of cathode elements which are made up of approximately 1 cm thick rods which are square in cross section. The sub-elements 14 feature a conductor part 12, vertical and horizontal parts 16 and 24 resp., and a working surface 22. Sub-elements which are wet by aluminum and are small in cross section are employed for the manufacture of cathode elements, if this offers advantages in manufacture over flat sub-elements.

Figure 4:
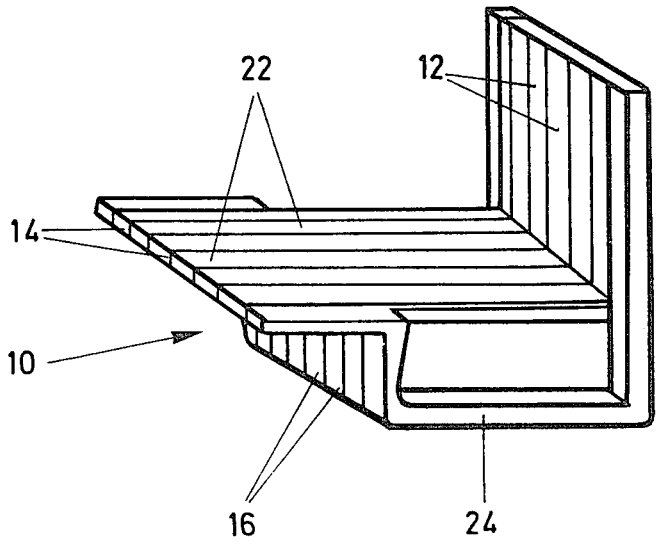
FIG. 4: A perspective view of a cathode element made up of sub-elements.
Figure 5:
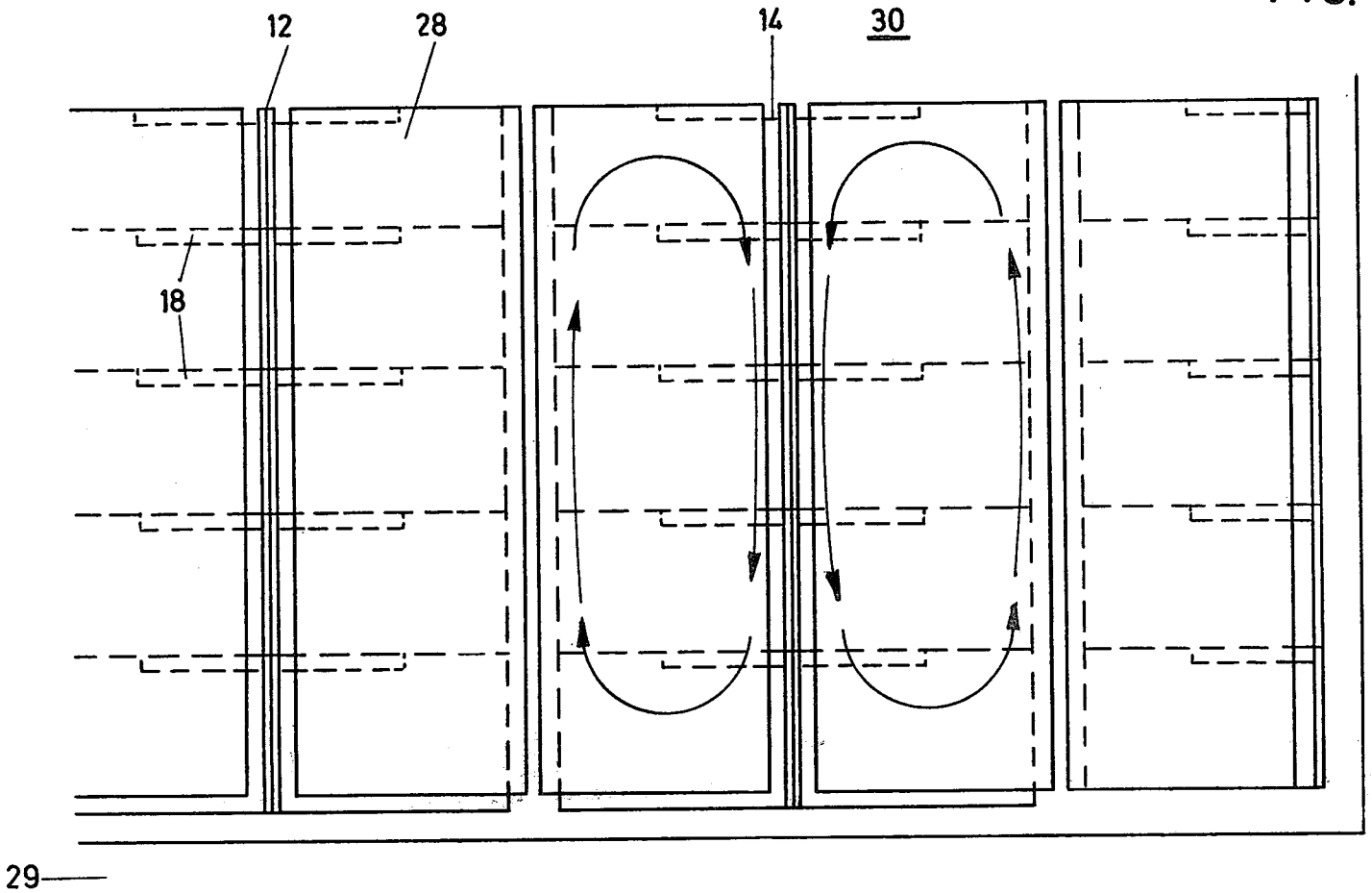
FIG. 5: A horizontal section through part of an electrolytic cell, sectioned at the level of the anodes.

FIG. 4 shows a cathode element 10 made up of the sub-elements 16 in FIGS. 2 and 3. The sequence of the approximately 1 cm thick sub-elements can be varied at will. If a sub-element from FIG. 3 is positioned between sub-elements of the kind shown in FIG. 2, then a slit is created which corresponds to the opening 18 in FIG. 1. In the electrolytic cell shown in FIG. 5 cathode elements of the type shown in FIG. 1 have been employed. These are connected by means of the vertical power supply parts 12 which are in contact with each other over the whole of the facing surfaces. The working surfaces of the sub-elements with openings 18 lie for the main part under the anodes 28. The working surfaces of these anodes measure 1500×50 mm. The border of the centrally fed cell is indicated by the numeral 29, the feeding gap by numeral 30. The most important directions of flow of electrolyte in the region of the cathode elements are indicated here by means of arrows.

Figure 6:
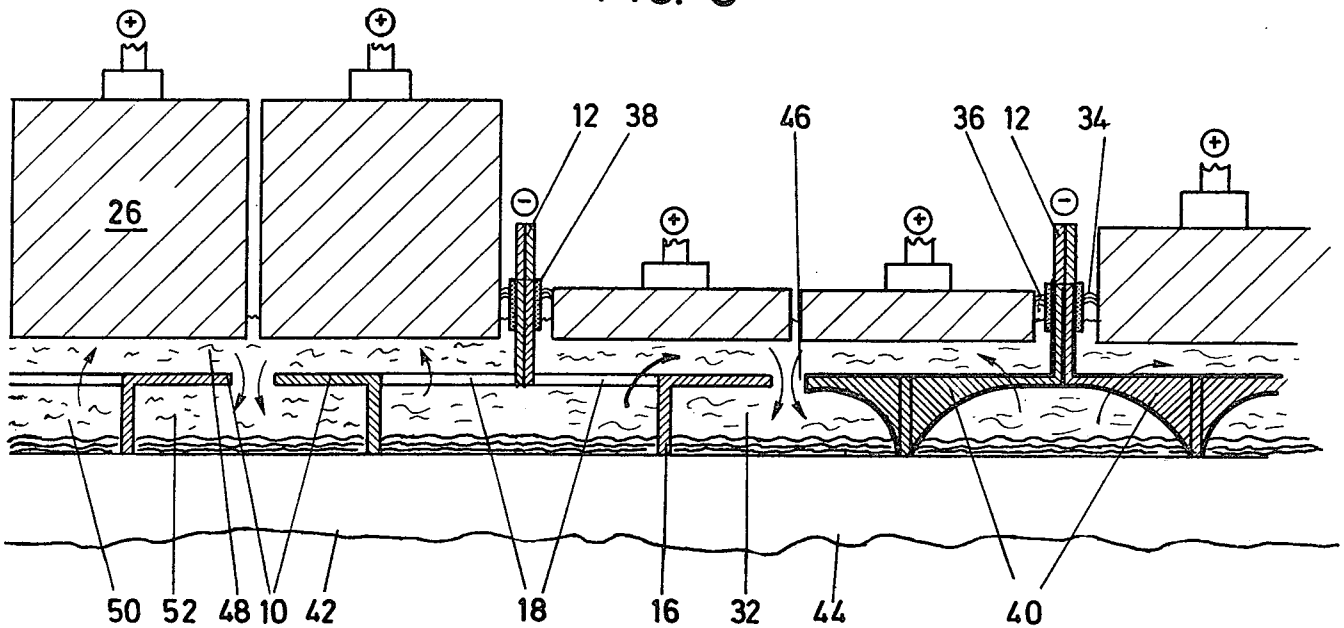
FIG. 6: A vertical, longitudinal section through part of an electrolytic cell.

FIG. 6 shows an electrolytic cell in which pairs of carbon anodes 26 are employed. These anodes 26 show different degrees of consumption due to burning off. The approximate dimensions of the working surface of the anodes correspond to those of the cathode elements 10 which support each other by means of their power supply components 12. These components 12 are connected near the top by means of a cathode busbar to a common power source not shown here. The conductor components 12 are provided with a protective sleeve 38 in the region of the interface between the electrolyte 32 and the atmosphere 36 under the crust 34 of solidified electrolyte. The sleeve 38 is made of a material which resists oxidation and does not dissolve early in cryolite such as solid cryolite supersaturated with alumina or corundum which has been baked at a high temperature.

The cathode elements 40 are made of a material which is highly conductive to electricity, for example steel or titanium coated completely with a material which is readily wet by, but can withstand molten aluminum, for example titanium carbide, titanium-diboride or pyrolitic graphite. The coating can take place via any known coating process or by affixing appropriately shaped plates. The wettable material must be electrically conductive and protect the underlying material from corrosive attack by the electrolyte. The cathode elements 40 also have vertical conductor components 12 which are completely joined to each other and support each other.

The cathode elements 10 and 40 stand on the carbon floor of the cell and dip into the pool of aluminum 44 which has separated out in the process. This way the liquid aluminum has the negative polarity of the cathode elements.

Between the ends of pairs of neighboring cathode elements there is a gap 46 running horizontally; this gap 46 is at least 1 cm wide. With the arrangement shown in FIG. 6 the volume of bath under each anode is divided into three horizontal channels running parallel to the longitudinal axis of the anodes. The first channel is the interpolar gap 48 which represents the actual working space where the electrolysis of the charge takes place and where the heat due to the resistance of the electrolyte is generated. Below this, separated by the supporting plate 16, are the channels 50 and 52 which are connected to the interpolar gap 48 hydraulically via the openings 18. There are therefore three channels per cathode element viz, one above and two below the working surface of the cathode element.

As current flows through the cell, an electromagnetic effect acting horizontally, in the longitudinal direction of the cell, develops in the gap between the anode and the cathode. Under the effect of the magneto-hydrodynamic forces the electrolyte and a thin film of aluminum on the cathode flow directionally (as shown by arrows) above the cathode elements from the conductor plates 12 in the direction of the gap 46 between the cathode elements. In channel 52 under this gap 46 the melt flows in the direction of the gap where the cell is fed with alumina i.e. perpendicular to the plane of the drawing. The aluminum 44 separated out by electrolysis collects on the floor 42 of the cell and is always maintained at a negative polarity with respect to the anodes by means of the supporting plates 16 dipping into it. The liquid aluminum therefore flows only slightly, as a result of small potential differences between the individual cathode elements. The effect of magnetic fields on the molten aluminum is minimal. During the electrolytic process, the alumina content of the molten charge in the interpolar gap 48 falls and the charge is heated to a higher temperature, as a result of the heat generated due to the electrical resistance of the charge. The spent and heated molten charge flows through the channel 52 under the gap 46 to the gap where the centrally fed cell is provided with fresh alumina. There the electrolyte dissolves alumina (falling in temperature at the same time) and then flows through the channel 50 which runs under the openings 18 back into the region of the working surface of the cathode elements. As a result of the suction effect due to the flow of electrolyte between anode and cathode, the electrolyte containing freshly dissolved alumina rises into the interpolar gap 48.

By reducing the interpolar distance to less than 2 cm less heat is generated on passing current through the electrolyte. It is therefore of greatest importance that the cell is extremely well insulated. Direct contact of the flowing electrolyte with the sidewall border can be partially or completely prevented by the provision of end plates—indicated by numeral 20 in FIG. 1, but not shown in FIG. 6.

Two basic advantages of the cathode elements of the invention emerge from FIG. 6 i.e. from cathode elements which can be in contact with the cell floor but not permanently attached to it:

(a) Any changes which may occur in the shape of the cell floor as a result of various effects during operation are less disadvantageous than is the case when the readily wetted cathode is permanently attached to the cell floor.

(b) The cathode elements can be changed without re-lining the pot, if they do not achieve the service life of the pot. It is economically advantageous and possibly also with respect to manufacturing, if it is not mandatory that the cathode elements exhibit the same service life as the lining of the pot. This allows more favorably priced materials of shorter lifetime e.g. titanium carbide or pyrolitic graphite to be employed for the cathode elements.

Figure 7:
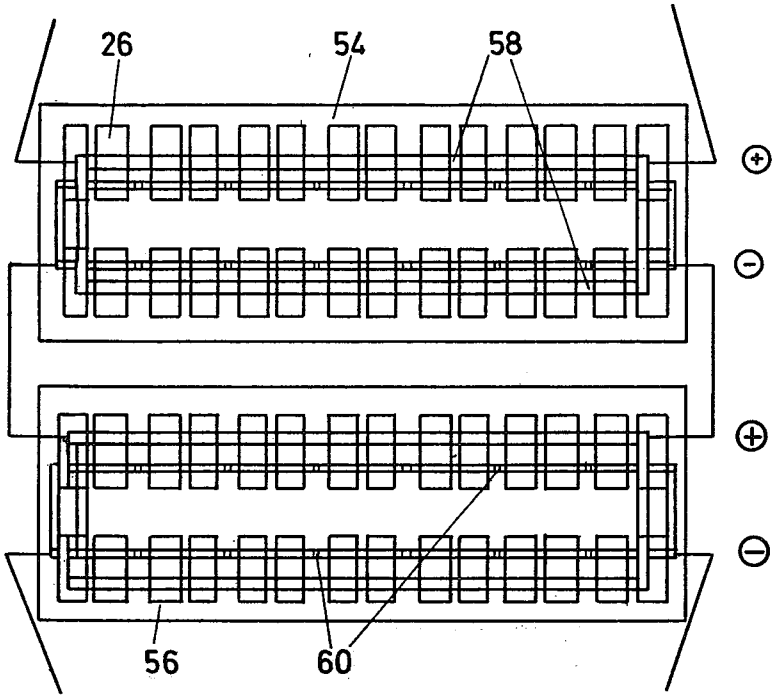
FIG. 7: A plan view of two electrolytic cells connected in series and running side-by-side, shown here at the level of the anodes and with power supply indicated.

FIG. 7 shows two electrolytic cells 54 and 56 which are connected in series and lie side-by-side. The anodes 26 are screwed on to the anode beams 58; the cathode elements, not shown here, are connected electrically to the cathode busbars 60. This simple and advantageous current supply is made possible by the cathode elements of the invention.

Figure 8:
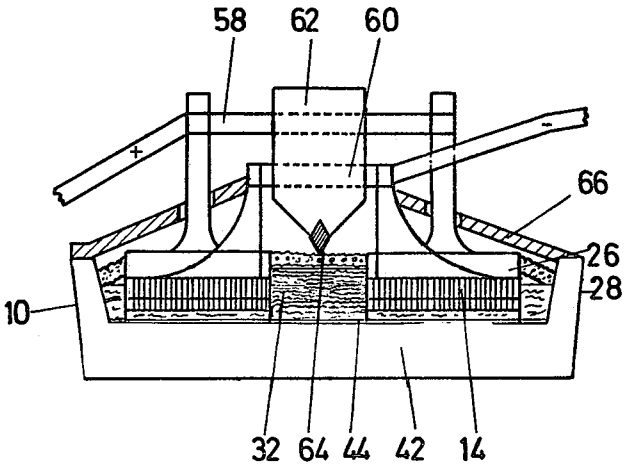
FIG. 8: An end view, in cross section, of a centrally fed electrolytic cell with cathode bars running in the longitudinal direction.

The centrally fed electrolytic cell in FIG. 8 shows the anodes 26 suspended from the anode beam 58, and the sub-elements 14 of the cathode elements 10 which are rod-shaped in form, running in the longitudinal direction of the cell and connected electrically to the cathode busbars 60. Also shown here is the alumina silo 62 with its crust breaker 64 fitted at the lower end. The centrally fed cell is fitted with hooding 66 which prevents the gases escaping to the pot room; the hooding 66 also diminishes heat losses from the cell.

Figure 9:
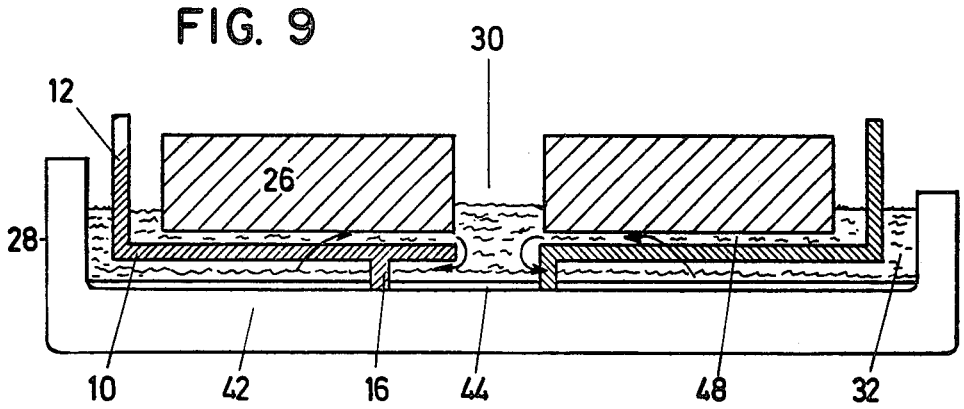
FIG. 9: A vertical section through a centrally fed electrolytic cell with cathode elements arranged parallel to the end face.
Figure 10:
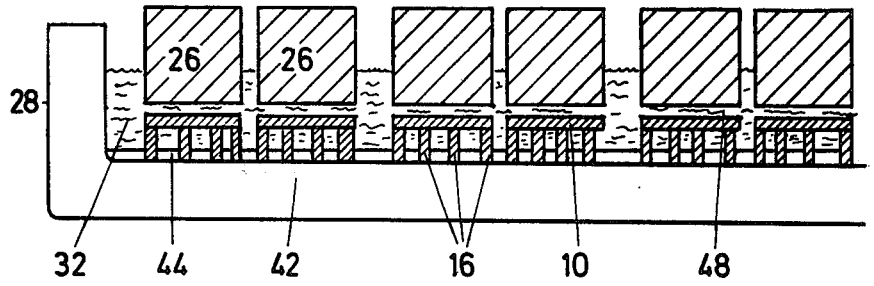
FIG. 10: A vertical, longitudinal section through part of the electrolytic cell shown in FIG. 9.

In the centrally fed cells shown in FIGS. 9 and 10 the cathode elements are at 90° from their position in the previous figures i.e. the vertical component 12 for the power supply is at the edge 28 on the long side of the cell. The sub-elements thus run parallel to the ends of the cell, as shown in FIG. 9. The various cathode elements 10 in FIGS. 11, 12 and 13 can be employed in the cells shown in FIGS. 9 and 10.

With this layout the electrolyte 32 flows in the interpolar gap 48 from the vertical component 12 in the direction of the opening 30 where alumina is fed to the bath. In the bath below the opening 30 newly fed alumina dissolves in the depleted electrolyte. The electrolyte then flows in the reverse direction under the working face of the cathode elements. The supporting plates 16 must therefore have openings for the electrolyte which is flowing back. These supporting plates 16 are situated either at the end of the cathode elements or displaced inwards. The electrolyte charged with newly dissolved alumina can rise into the interpolar gap 48 via the opening 18.

The arrangement shown in FIGS. 9 and 10 feature certain advantages over the previous versions with respect to electrolyte flow, as the cross section of the channels through which the electrolyte flows back is larger. This advantage is attained at the expense of increasing the distance through which the precipitated metal film has to flow and also the distance the electric current has to travel in the cathode element 10. To prevent larger electrical losses therefore, the cathode elements have a larger cross section. This means however a larger mass of cathode material; the cathode elements used with the arrangement shown in FIGS. 9 and 10 are therefore preferably the version coated with readily wettable material.

It is obvious that in the one and the same electrolytic cell longitudinal or transverse cathode elements can be employed, depending on the kind of flow pattern required.

With all versions of cathode element and their arrangement the distance between the working face of the cathode elements and the upper surface of liquid aluminum on the floor of the cell must be at least the same as the interpolar distance in the classical Hall-Heroult cell with deep metal bath. If this were not the case, then it would not be certain that the interpolar gap 48 would be supplied with sufficient electrolyte 32 charged with alumina. This also ensures that only a negligible amount of the electrolyzing current flows through a leak between the anode and the metal bath. Consequently, the movement of the bath and the doming of the molten charge by electro-magnetic forces are kept small. The flow of an electric current between cathode and liquid metal is prevented by the fact that, as mentioned above, the supporting plate 16 dips into the liquid metal. The cathode elements and the precipitated liquid metal are therefore at the same potential and the current efficiency is improved, because none of the liquid aluminum which has already been deposited is dispersed by the newly deposited metal.

What is claimed is:

1. A wettable cathode for an electrolytic cell for the electrolysis of a molten electrolyte, in particular for the production of aluminum, wherein the said cathode comprises individual, exchangeable elements each having at least one component thereof for the supply of electrical power connected to an active surface thereof which in turn is connected to a supporting plate thereof, said elements being electrically conductive and having their surfaces being made of a material which is readily wet by but can withstand molten aluminum, wherein at least some of the cathode elements have at least one recess or opening through which electrolyte can flow.

2. A wettable cathode according to claim 1 wherein the said cathode elements are made up from sub-elements.

3. A wettable cathode according to claim 2 wherein the sub-elements are rod-shaped.

4. A wettable cathode according to claim 2 wherein the sub-elements are square in cross section.

5. A wettable cathode according to claim 1 wherein the cathode elements have at least one recess or opening through which electrolyte can flow.

6. A wettable cathode according to claim 1 wherein the power supply component is vertical.

7. A wettable cathode according to claim 1 wherein the cathode elements are made completely of readily wettable material.

8. A wettable cathode according to claim 7 wherein said exchangeable elements are made of a material selected from the group consisting of titanium carbide, titanium di-boride and pyrolitic graphite.

9. A wettable cathode according to claim 1 wherein the cathode elements are made of a material which readily conducts electricity and are completely coated with a readily wettable material.

10. A wettable cathode according to claim 9 wherein said material which readily conducts electricity selected from the group consisting of steel and titanium, wherein said coating is selected from the group consisting of titanium carbide, titanium di-boride and pyrolitic graphite.

11. A wettable cathode according to claim 1 wherein said power supply component is connected to a horizontal active surface and said horizontal active surface is connected to a supporting plate.

12. A wettable cathode according to claim 11 wherein cathode elements are connected electrically by said supporting plate by molten metal separated out in the electrolytic process.

13. An electrolytic cell for the electrolysis of a molten electrolyte having anode and cathode elements and an electrolyte, in particular for the production of aluminum, said cell having exchangeable cathode elements each having at least one component thereof for the supply of electrical power connected to an active surface thereof which in turn is connected to a supporting plate thereof, wherein the cathode elements are connected electrically via said supporting plate by molten metal separated out in the electrolytic process, wherein at least some of the cathode elements have at least one recess or opening through which electrolyte can flow.

14. An electrolytic cell according to claim 13 wherein said elements are electrically conductive and have their surfaces made of a material which is readily wet by but can withstand molten aluminum.

15. An electrolytic cell according to claim 14 wherein said anode and cathode elements have working faces and wherein the interpolar distance between the working faces of the anodes and the cathode elements is at most 2 cm, and the distance between the working faces of the cathode elements and the top surface of the molten metal which has separated out is at least 4 cm.

16. An electrolytic cell according to claim 15 wherein said interpolar distance is from 1 to 2 cm, and wherein said distance between the cathode elements and said top surface is 6 to 12 cm.

17. An electrolytic cell according to claim 13 wherein the cathode elements can be moved vertically.

18. An electrolytic cell according to claim 17 wherein said cathode elements can be moved simultaneously.

19. An electrolytic cell according to claim 13 wherein said anodes have working faces immersed in said electrolyte and wherein the active surfaces of said cathode elements are beneath and substantially coextensive with the working faces of the anodes.

20. A wettable cathode for an electrolytic cell for the electrolysis of a molten electrolyte, in particular for the production of aluminum, wherein the said cathode comprises individual, exchangeable elements each having at least one component thereof for the supply of electrical power connected to a horizontal active surface thereof which in turn is connected to a supporting plate thereof, said elements being electrically conductive and having their surfaces being made of a material which is readily wet by but can withstand molten aluminum, wherein the cathode elements are connected electrically by said supporting plate by molten metal separated out in the electrolytic process and wherein said power supply component extends vertically out of the electrolyte and said supporting plate extends in the opposite direction.

21. An electrolytic cell for the electrolysis of a molten electrolyte having anode and cathode elements and an electrolyte, in particular for the production of aluminum, said cell having exchangeable cathode elements each having at least one component thereof for the supply of electrical power connected to an active surface thereof which in turn is connected to a supporting plate thereof, wherein the cathode elements are connected electrically via said supporting plate by molten metal separated out in the electrolytic process, wherein said elements have a vertical power supply component, a horizontal active surface connected thereto, and a supporting plate connected to said horizontal surface.

22. An electrolytic cell for the electrolysis of a molten electrolyte having anode and cathode elements and an electrolyte, in particular for the production of aluminum, said cell having exchangeable cathode elements each having at least one component thereof for the supply of electrical power connected to an active surface thereof which in turn is connected to a supporting plate thereof, wherein the cathode elements are connected electrically via said supporting plate by molten metal separated out in the electrolytic process, wherein the anode elements have a longitudinal axis and wherein said cell contains a plurality of said anode and cathode elements arranged so that the volume of electrolyte under each anode is divided by said cathode elements into three horizontal channels running parallel to the longitudinal axis of the anodes.

23. An electrolytic cell according to claim 22 including a gap at least one cm wide between the ends of pairs of neighboring cathode elements.

24. An electrolytic cell according to claim 22 wherein said vertical component is adjacent the side wall of the anode and the distance between said vertical component and said anode side wall is from 3 to 10 cm.

25. An electrolytic cell according to claim 22 wherein said vertical power supply component extends out of the electrolyte and is provided with a protective sleeve in the region of the interface between the electrolyte and the atmosphere.

26. An electrolytic cell according to claim 22 wherein adjacent cathode elements have vertical power supply components joined to each other and supporting each other.

* * * * *